US008781388B2

(12) United States Patent
Yamaguchi et al.

(10) Patent No.: US 8,781,388 B2
(45) Date of Patent: Jul. 15, 2014

(54) IMAGE FORMING DEVICE

(75) Inventors: Takuya Yamaguchi, Toyokawa (JP); Yoshiteru Hattori, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 520 days.

(21) Appl. No.: 13/075,496

(22) Filed: Mar. 30, 2011

(65) Prior Publication Data

US 2012/0025453 A1 Feb. 2, 2012

(30) Foreign Application Priority Data

Jul. 30, 2010 (JP) ..... 2010-171383

(51) Int. Cl.
*G03G 15/00* (2006.01)
*B65H 3/52* (2006.01)

(52) U.S. Cl.
USPC ..... 399/401; 399/309; 399/364; 271/121; 271/124; 271/125

(58) Field of Classification Search
CPC ..... B65H 3/0607; B65H 3/5215; B65H 85/00
USPC ..... 399/401, 309, 364; 271/124, 125, 121
See application file for complete search history.

(56) References Cited

U.S. PATENT DOCUMENTS

| | | | | |
|---|---|---|---|---|
| 3,994,209 | A * | 11/1976 | Jacob | 493/28 |
| 5,988,628 | A * | 11/1999 | Mori | 271/117 |
| 2001/0031161 | A1* | 10/2001 | Nakazato | 399/388 |
| 2003/0108359 | A1* | 6/2003 | Chung | 399/124 |
| 2006/0023050 | A1 | 2/2006 | Nishiberi et al. | |
| 2006/0285904 | A1 | 12/2006 | Yoshida | |
| 2008/0240824 | A1* | 10/2008 | Asada | 399/405 |
| 2009/0014940 | A1* | 1/2009 | Lim | 271/3.14 |

FOREIGN PATENT DOCUMENTS

| | | | |
|---|---|---|---|
| CN | 101181967 | A | 5/2008 |
| JP | S64-002944 | A | 1/1989 |
| JP | H08-067366 | A | 3/1996 |

(Continued)

OTHER PUBLICATIONS

Japan Patent Office, Notification of Reasons for Rejection for Japanese Patent Application No. 2011-047286 (counterpart to above-captioned patent application), mailed Jul. 30, 2013.
Japan Patent Office, Notification of Reasons for Rejection for Japanese Patent Application No. 2011-047286 (counterpart to above-captioned patent application), mailed Oct. 22, 2013.
State Intellectual Property Office of the People's Republic of China, Notification of First Office Action for Chinese Patent Application No. 201110085176.8 (counterpart to above-captioned patent application), mailed Oct. 15, 2013.

(Continued)

*Primary Examiner* — Matthew G Marini
*Assistant Examiner* — Allister Primo
(74) *Attorney, Agent, or Firm* — Baker Botts L.L.P.

(57) ABSTRACT

An image forming device, comprising: a sheet-like medium accommodation unit; a supply member that carries a sheet-like medium; a pair of separation members that separate the sheet-like medium one by one; an image formation unit; a carrying path; a re-carrying unit to move inversely the sheet-like medium whose top face has been subjected to printing; a moving mechanism to move the supply member close to or away from the sheet-like medium and to move the pair of separation members close to or away from each other so that a path for the inversely carried sheet-like medium is formed; and a control unit to control the moving mechanism such that, when back-face printing is performed, the supply member is in a state of being moved away from the sheet-like medium and the pair of separation members are in a state of being moved away from each other.

12 Claims, 9 Drawing Sheets

(56) References Cited

FOREIGN PATENT DOCUMENTS

| | | | |
|---|---|---|---|
| JP | H09-006061 | A | 1/1997 |
| JP | H09-100071 | A | 4/1997 |
| JP | 2003-081507 | A | 3/2003 |
| JP | 2006-036518 | A | 2/2006 |
| JP | 2007-001673 | A | 1/2007 |
| JP | 2008-247537 | A | 10/2008 |
| JP | 2010-024032 | A | 2/2010 |

OTHER PUBLICATIONS

Japan Patent Office, Decision for Dismissal of Amendment for Japanese Patent Application No. 2011-047286 (related to above-captioned patent application), mailed Jan. 28, 2014.

Japan Patent Office, Decision of Rejection for Japanese Patent Application No. 2011-047286 (related to above-captioned patent application), mailed Jan. 28, 2014.

* cited by examiner

IMAGE FORMING DEVICE

CROSS-REFERENCE TO RELATED APPLICATION

This application claims priority under 35 U.S.C. §119 from Japanese Patent Application No. 2010-171383, filed on Jul. 30, 2010. The entire subject matter of the application is incorporated herein by reference.

BACKGROUND

1. Technical Field

Aspects of the present invention relate to an image forming device capable of executing both-side printing.

2. Related Art

Conventionally, image forming devices capable of executing both-side printing have been widely used. In general, such an image forming device includes a paper supply roller for supplying a sheet of paper in a paper supply tray, a paper carrying path formed to have a shape of a letter U, an image formation unit and a re-carrying mechanism configured such that the sheet of paper which has been subjected to top-face printing by the image formation unit is reversed and is carried again to the paper supply roller through a space between the paper supply tray and the image formation unit.

Such a image formation unit is also provided with a pair of separation rollers for separating one by one the sheets of paper sent out by the paper supply roller.

However, in the above described configuration, there is a case where an image (toner) printed on the top face of the sheet of paper adheres to the separation rollers when the sheet of paper which has been subjected to the top face printing runs into a nipping portion of the pair of separation rollers during the back-face printing. If the toner adheres to the separation rollers, the separating property of the separation roller deteriorates in regard to the sheet of paper being carried from a paper accommodation unit during the top-face printing, and thereby the duplicate paper carrying may be caused.

SUMMARY

Aspects of the present invention are advantageous in that they provide an image forming device capable of preventing occurrence of the duplicate carrying of a sheet-like medium supplied from a paper accommodation unit during top-face printing, by preventing an image formed on a top face of the sheet-like medium from adhering to a separation member.

According to an aspect of the invention, there is provided a sheet-like medium accommodation unit provided in a lower part of a main body; a supply member that carries a sheet-like medium accommodated in the sheet-like medium accommodation unit; a pair of separation members that separate the sheet-like medium carried by the supply member one by one and carry the sheet-like medium; an image formation unit that is arranged above the sheet-like medium accommodation unit and is configured to form an image on the sheet-like medium carried from the pair of separation members; a carrying path that is formed in a shape of a letter U to connect the sheet-like medium accommodation unit with the image formation unit, the supply member and the pair of separation members being arranged along the carrying path; a re-carrying unit configured to move inversely the sheet-like medium whose top face has been subjected to printing by the image formation unit and to carry again the inversely moved sheet-like medium to the image formation unit through a portion between the supply member and the sheet-like medium accommodated in the sheet-like medium accommodation unit and a portion between the pair of separation members; a moving mechanism configured to move the supply member close to or away from the sheet-like medium accommodated in the sheet-like medium accommodation unit and to move the pair of separation members close to or away from each other so that a path for the inversely carried sheet-like medium is formed between the supply member and the sheet-like medium accommodated in the sheet-like medium accommodation unit and between the pair of separation members; and a control unit configured to control the moving mechanism such that, when back-face printing is performed, the supply member is in a state of being moved away from the sheet-like medium accommodated in the sheet-like medium accommodation unit and the pair of separation members are in a state of being moved away from each other.

BRIEF DESCRIPTION OF THE ACCOMPANYING DRAWINGS

DETAILED DESCRIPTION

Figure 1:
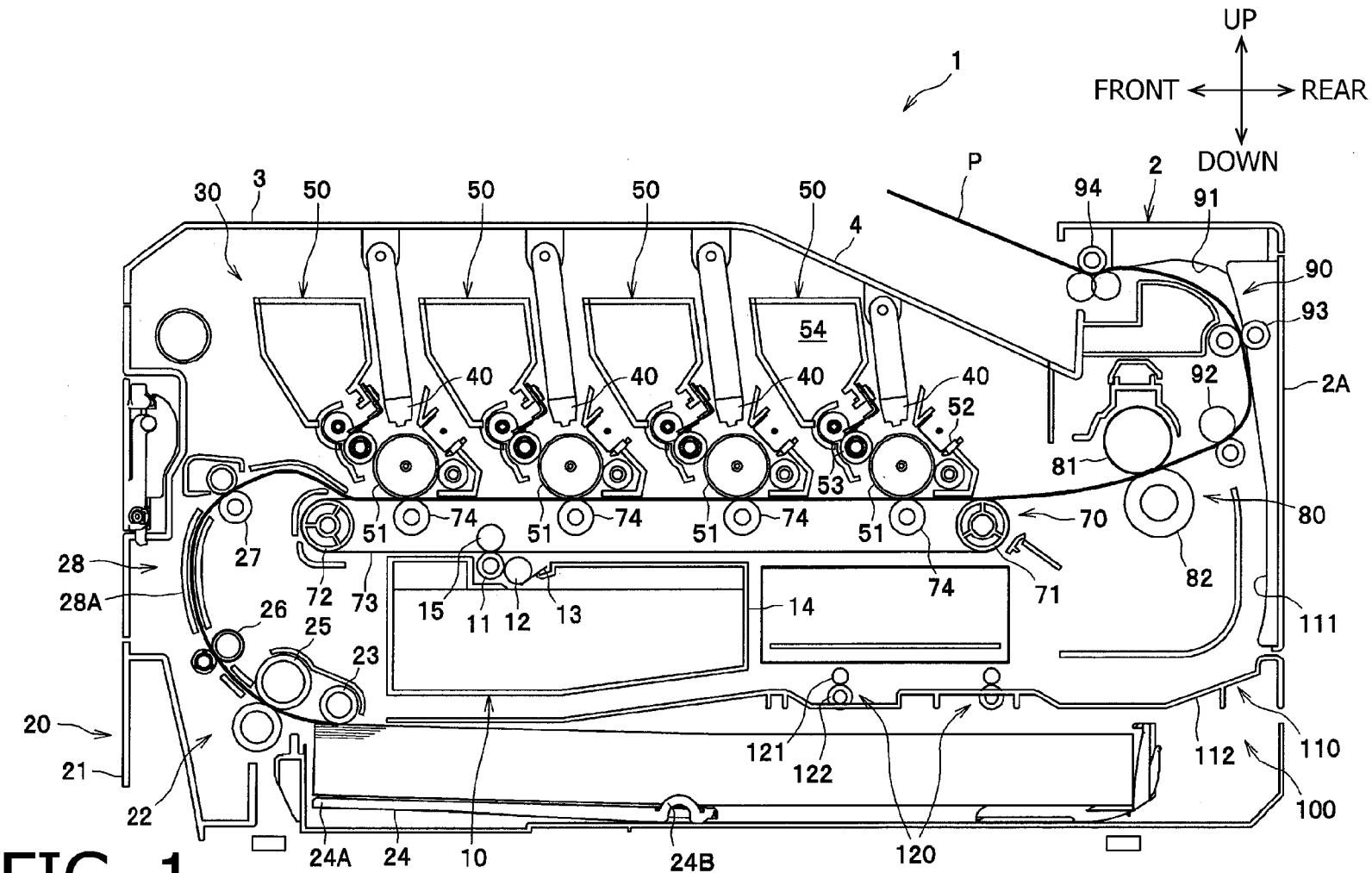
FIG. 1 is illustrates a configuration of a color printer according to an embodiment.

Hereafter, embodiments according to the invention will be described with reference to the accompanying drawings. In the following, first a general configuration of a color printer which is an example of an image forming device is explained, and thereafter the feature of the color printer is explained in detail In the following explanation, directions are defined with respect to a user's position defined when the user uses the color printer. That is, the left side on FIG. 1 is defined as a "front side", the right side on FIG. 1 is defined as a "rear side", a far side on FIG. 1 is defined as a "left side", and a near side on FIG. 1 is defined as a "right side". An up and down direction on FIG. 1 is defined as a vertical direction.

First Embodiment

As shown in FIG. 1, a color printer 1 according to the embodiment includes, in a main body 2, a paper supply unit 20 which supplies a sheet of paper P (which is an example of a sheet-like medium), an image formation unit 30 which forms (i.e., prints) an image on the supplied sheet of paper P, and a paper ejection unit 90 which ejects the sheet of paper P on which an image has been formed.

The paper supply unit 20 includes a paper supply tray 21 (a sheet-like medium accommodation unit) and a paper supply mechanism 22 which carries the sheet of paper P from the paper supply tray 21 to the image formation unit 30. The paper supply tray 21 is arranged, at the lower part of the main body 2, to be detachably attachable with respect to the main body 2. The paper supply tray 21 accommodates a stack of sheets of paper P, and includes a pressure plate 24 serving to lift the sheets of paper P toward a paper supply roller 23.

The paper supply mechanism 22 includes the paper supply roller 23 (an example of a paper supply member which carries the sheet of paper P in the paper supply tray 21), a pair of separation rollers 25 (a pair of separation members), and a plurality of pairs of carrying rollers 26 and 27. The paper supply roller 23 and the separation rollers 25 are provided in a central part of the sheet of paper P in the width direction of the sheet of paper P. The paper supply mechanism 22 will be explained in detail later.

The rollers 23 and 25 to 27 are arranged along a paper carrying path 28 formed to connect the paper supply tray 21 with the image formation unit 30. The paper carrying path 28 is formed to have a shape of a letter "U" with a pair of arc-like guides 28A.

In the paper supply unit 20 configured as described above, the sheets of paper P are sent out by the paper supply roller 23, and the sheets of paper P sent out by the paper supply roller 23 are separated one by one by the separation rollers 25. The sheet of paper P sent out by the separation rollers 25 is pinched and carried by the carrying rollers 26. Then, the sheet of paper P is turned to the rear side while proceeding along the paper carrying path 28, and is supplied to the image formation unit 30.

The image formation unit 30 is located on the upper side of the paper supply tray 21, and includes exposure units 40, four process cartridges 50, a transfer unit 70, a belt cleaner 10, and a fixing unit 80.

Various types of known exposing manners, such as laser exposing and LED exposing, can be employed in the exposure unit 40. In this embodiment, LED arrays are employed respectively for the process cartridges 50. Each LED array is supported by an upper cover 3.

The process cartridges 50 are arranged in the front and rear direction between the upper cover 3 and the paper supply unit 20. Each process cartridge 50 includes a photosensitive drum 51 on which an electrostatic latent image is formed, a charger 52, a development roller 53 and a toner chamber 54 in which toner (an example of a developer) stored. The four process cartridges 50 store black toner, yellow toner, magenta toner and cyan toner, respectively.

The transfer unit 70 is arranged between the paper supply unit 20 and the process cartridges 50, and includes a drive roller 71, a driven roller 72, a carrying belt 73 and four transfer rollers 74.

The drive roller 71 and the driven roller 72 are arranged to be away from each other in the front and rear direction and to be in parallel with the front and rear direction. The carrying belt 73 (an endless belt) is hooked to the drive roller 71 and the driven roller 72 to be stretched between the drive roller 71 and the driven roller 72. The four transfer rollers 74 are arranged inside the carrying belt 73 such that the transfer rollers 74 face the photosensitive drums 51, respectively, to pinch the sheet of paper P between the transfer rollers 74 and the photosensitive drums 51. Each transfer roller is applied a transfer bias through constant current control during the transferring.

The belt cleaner 10 is arranged under the carrying belt 73. The belt cleaner 10 contacts the carrying belt 73 to collect substances, such as toner and dust, adhered to the carrying belt 73. Specifically, the belt cleaner 10 includes a contacting roller 11, a collecting roller 12, a blade 13 and a discharged toner chamber 14.

The contacting roller 11 is arranged to contact an outer circumferential surface of the carrying belt 73. By applying a collecting bias between the contacting roller 11 and a backup roller 15 located to contact the inner surface of the carrying belt 73, the contacting roller 11 collects the adhered substances on the carrying belt 73.

The collecting roller 12 contacts the contacting roller 11, and collects the adhered substances on the contacting roller 11. The adhered substances on the collecting roller 12 are scraped off by the blade 13 arranged to contact the collecting roller 12, and enter into the discharged tone chamber 14.

The fixing unit 80 is arranged on the rear side of the process cartridges 50 and the transfer unit 70. The fixing unit 80 includes a heat roller 81, and a pressure roller 82 which is located to face the heat roller 81 to press the heat roller 81.

In the image formation unit 30 configured as described above, surfaces of the photosensitive drums 51 are charged uniformly and positively by the respective chargers 52, and then are exposed based on image data by the respective exposure units 40. As a result, the potential of an exposed portion on each photosensitive drum 51 decreases, so that an electrostatic latent image is formed on each photosensitive drum 51. Thereafter, by supplying the toner from the development roller 53 to the electrostatic latent image, a toner image is formed on each photosensitive drum 51.

The sheet of paper P supplied on the carrying belt 73 is carried between each photosensitive drum 51 and each transfer roller 74 located inside the carrying belt 73. Consequently, the toner image formed on each photosensitive drum 51 is transferred to the sheet of paper P. Then, the sheet of paper P is carried between the heat roller 81 and the pressure roller 82. As a result, the toner image transferred on the sheet of paper P is heat-fixed.

The paper ejection unit 90 includes an ejection side carrying path 91 which is elongated upward from an exit of the fixing unit 80 and is turned toward the front side, and ejection rollers 92, 93 and 94. The sheet of paper P on which the toner image is heat-fixed is carried along the ejection side carrying path 91 by the ejection rollers 92, 93 and 94, and is ejected to a paper output tray 4.

The ejection rollers 93 and 94 of the paper ejection unit 90 constitutes a part of a re-carrying mechanism 100 configured to inversely move the sheet of paper P on which an image has been formed by the image formation unit 30 and to return the sheet of paper P to the upstream side of the image formation unit 30. The re-carrying mechanism 100 is explained in detail later.

The re-carrying mechanism 100 operates as follows. In a back-face printing mode, the sheet of paper P whose top face has been subjected to the image formation is ejected to a midway point between the ejection roller 94 and the paper output tray 4, and thereafter is moved inversely by inverse rotation of the ejection roller 94. Then, the sheet of paper P is carried again to the paper supply roller 23 through the space between the image formation unit 30 (the belt cleaner 10) and the paper supply tray 21. Then, the sheet of paper P proceeds along the paper carrying path 28, so that the sheet of paper P is supplied again to the upstream portion of the image formation unit 30 in a state where the sheet of paper P is reversed. As a result, an image is formed on a back face of the sheet of paper P by the image formation unit 30, and then the sheet of paper P which has been subjected to the both-side printing is ejected to the paper output tray 4.

Hereafter, the configuration of the paper supply mechanism 22 is explained in detail.

Figure 3A:
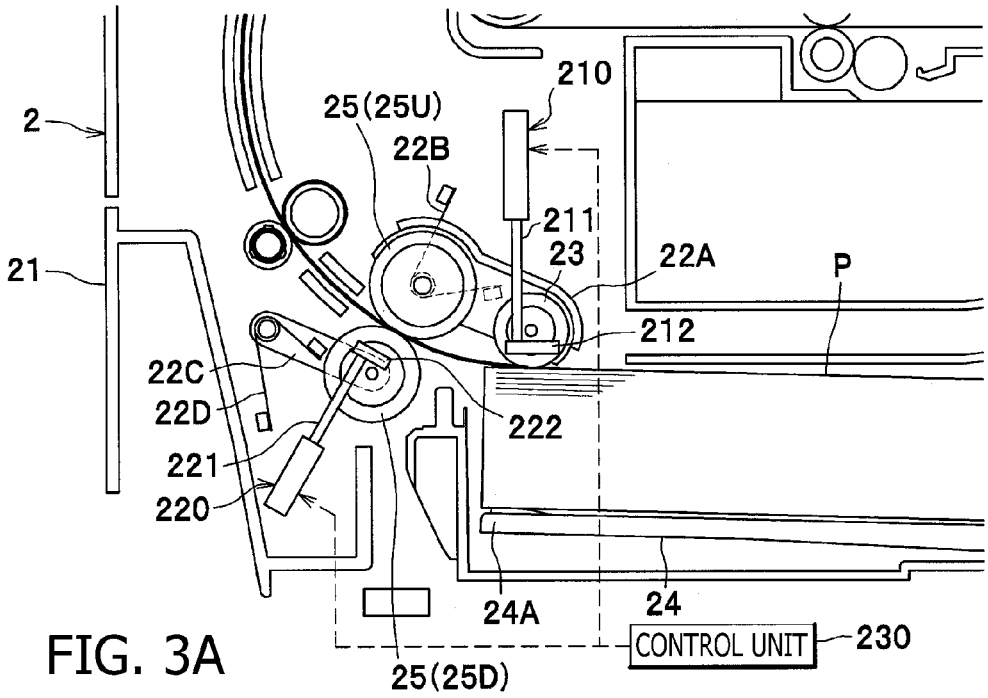
FIG. 3A illustrates a configuration around a paper supply roller and separation rollers during top-face printing.

As shown in FIG. 3A, in the paper supply mechanism 22, the paper supply roller 23 is rotatably supported by a bracket 22A. The separation rollers 25 include an upper separation roller 25U which rotates in the same rotational direction as that of the paper supply roller 23, and a lower separation roller 25D which serves as a friction member.

The bracket 22A is arranged to be able to swing with respect to the rotation axis of the upper separation roller 25U which is rotatably attached to the main body 2, and a tip part of the bracket 22A rotatably supports the paper supply roller 23. With this configuration, the paper supply roller 23 is able to move toward or move away from the sheet of paper P supported by the pressure plate 24.

The pressure plate 24 is arranged such that a front end part 24A is able to swing up and down with respect to a rear end part 24B (see FIG. 1) by a driving mechanism having a known structure (not shown) so as to lift up the leading edge part of the sheets of paper P. The pressure plate 24 is moved upward by a spring or a driving mechanism (which uses a motor and a gear) according to a fourth embodiment shown in FIG. 7.

Upward movement of the pressure plate 24 is limited at a predetermined height so that the position of the leading edge part of the sheet of paper placed on the top of the stack of sheets of paper is kept at a constant height.

The lower separation roller 25D of the separation rollers 25 is rotatably supported by an end of an arm 22C which is rotatably supported by the main body 2. As a result, the lower separation roller 25D is able to move toward or move away from the upper separation roller 25U.

For the paper supply roller 23, a first moving mechanism configured to move the paper supply roller 23 toward the sheets of paper P accommodated in the paper supply tray 21 or move the paper supply roller 23 away from the sheets of paper P accommodated in the paper supply tray 21 is arranged. For the lower separation roller 25D, a second moving mechanism configured to move the lower separation roller 25D toward the upper separation roller 25U or move the lower separation roller 25D away from the upper separation roller 25U is arranged.

The first moving mechanism includes an actuator 210 (e.g., a solenoid or a motor) having an advancing shaft 211, and a first spring 22B pressing the bracket 22A. The bracket 22A is pressed by the first spring 22B such that the paper supply roller 23 contacts the sheet of paper P accommodated in the paper supply tray 21. In the state where the paper supply roller 23 contacts the sheet of paper P, the paper supply roller 23 is able to carry the sheet of paper by rotation. At a tip of the advancing shaft 211, a hook part 212 which is able to be hooked to the rotation shaft of the paper supply roller 23 (or a part of the bracket 22A) in the advancing and backing direction of the advancing shaft 211 is provided. The actuator 210 is configured such that, by moving the advancing shaft 211 to back, the hook part 212 can be hooked to the rotation axis of the paper supply roller 23 and thereby the paper supply roller 23 can be lifted up upward against the pressing force of the first spring 22B.

In another embodiment, the first spring 22B may be omitted, and the paper supply roller 23 may be pressed to contact the sheet of paper P accommodated in the paper supply tray 21 by the weight of paper supply roller 23 and the bracket 22A.

The second moving mechanism includes an actuator 220 (a solenoid or a motor) having an advancing shaft 221 which is able to advance and back in the substantially vertical direction, and a second spring 22D which presses the arm 22C. The arm 22C is pressed by the second spring 22D such that the lower separation roller 25D contacts the upper separation roller 25U. At a tip of the advancing shaft 211, a hook part 222 which is able to be hooked to the rotation axis of the lower separation roller 25D (or a part of the arm 22C) in the advancing and backing direction of the advancing shaft 221. The actuator 220 is configured such that, by backing the advancing shaft 221, the hook part 222 can be hooked to the rotation axis of the lower separation roller 25 and thereby the lower separation roller 25D can be moved away from the upper separation roller 25U against the pressing force of the second spring 22D.

Each of the first and second actuators 210 and 220 is controlled by a control unit 230. Specifically, the control unit 230 has a CPU, a ROM and a RAM (not shown), and operates in accordance with a program stored in advance. For example, the control unit 230 receives a print command (print data), and controls the paper supply unit 20, the image formation unit 30, the paper ejection unit 90, the re-carrying unit 100, the first and second actuators 210 and 220.

In this embodiment, when a back-face printing is performed, the control unit 230 controls the first and second actuators 210 and 220 such that the paper supply roller 23 and the sheet of paper P move away with respect to each other, and the pair of separation rollers 25 move away with respect to each other. It should be noted that although the control unit 230 is provided in the main body 2, in the drawings the control unit 230 is illustrated outside the main body 2 for the sake of convenience.

Hereafter, the re-carrying mechanism 100 is explained. As shown in FIG. 1, the re-carrying mechanism 100 includes the ejection rollers 93 and 94, a re-carrying path 110 having a form of a letter "U" to guide the inversely moved sheet of paper P by the ejection rollers 93 and 94 toward the paper supply roller 23, and re-carrying rollers 120 (two pairs of rollers) provided along the re-carrying path 110. The re-carrying path 110 includes members (e.g., a plurality of ribs 111 formed on a rear cover 2A of the main body 2) constituting the ejection side carrying path 91, and a carrying guide 112 formed to be substantially horizontal so as to let the sheet of paper P to pass between the paper supply tray 21 and the image formation unit 30 (the belt cleaner 10).

The re-carrying rollers 120 are two pair of rollers carrying the sheet of paper P while pinching the sheet of paper P therebetween. Of the pair of rollers 120, a roller 121 contacting the top face of the sheet of paper P on which an image has been formed is made of resin, and the other roller 122 contacting the back face of the sheet of paper P is made of rubber having a high degree of friction with respect to a sheet of paper. In comparison with rubber as material of the roller 122, the resin as material of the roller 121 has a property that an image formed on the top face of the sheet of paper is hard to adhere to resin. Therefore, it is possible to prevent the toner from adhering again to the top face of the sheet of paper P from the roller 121. As a result, it becomes possible to enhance the quality of the image formed on the sheet of paper P.

The pair of re-carrying rollers 120 of the two pair of rollers 120 placed on the downstream side in the paper carrying direction and the carrying rollers 26 located on the downstream side of the separation roller 25 are arranged to have an interval smaller than or equal to the length of the sheet of paper P having the minimum permissible size available for the back-face printing executed on the color printer 1. As a result, even when the paper supply roller 23 is moved away from the sheet of paper P and the part of separation rollers 25 move away with respect to each other during the back face printing, the sheet of paper P having the minimum permissible size can be carried securely between the re-carrying rollers 120 and the carrying rollers 26 which are arranged both sides of the carrying direction.

Figure 2:
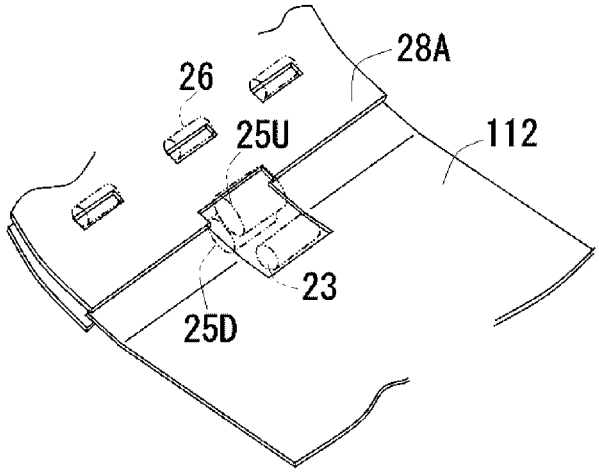
FIG. 2 illustrates a configuration of a carrying guide in the color printer.

As shown in FIG. 2, the carrying guide 112 is formed to extend to the front side from the rear side of the color printer 1, and the downstream edge of the carrying guide 112 reaches the position close to the guide 28A of the paper carrying path. Specifically, the downstream edge of the carrying guide 112 is formed such that a part of the downstream edge where the paper supply roller 23 and the separation roller 25 are located is cut off so that the paper supply roller 23 and the sheet of paper P in the paper supply tray 121 are able to contact with each other and the separation roller 25 are able to contact with each other during the top-face printing. It should be noted that the lower edge of the carrying guide 112 may be positioned on the rear side of the paper supply roller 23, and, during the back-face printing, the sheet of paper P may be guided from the re-carrying mechanism 100 to the paper carrying path 28, by utilizing the sheet of paper P which the paper supply roller 23 has separated between the carrying guide 112 and the guide 28A.

Hereafter, the both-side printing is explained in detail.

As shown in FIG. 3A, when the both-side printing is executed, the paper supply roller 23 is pressed to contact the sheet of paper P in the paper supply tray 21 by the pressing force of the first spring 22B, and the pair of separation rollers 25 contact with each other by the pressing force of the second spring 22D.

The sheets of paper P in the paper supply tray 21 are sent out by the paper supply roller 23, and are separated one by one by the pair of separation rollers 25. At this time, the lower separation roller 25D of the separation rollers 25 is driven by a driving source (having a known configuration), via a torque limiter, to rotate in the inverse direction of the carrying direction of the sheet of paper P. When more than one sheets of paper P enter the position between pair of separation rollers 25, the sheet of paper contacting the lower separation roller 25D is returned in the inverse direction of the carrying direction. Then, the sheet of paper P is subjected to the top-face printing, and thereafter is moved inversely by the ejection rollers 93 and 94 to be guided to the re-carrying path 110.

Figure 3B:
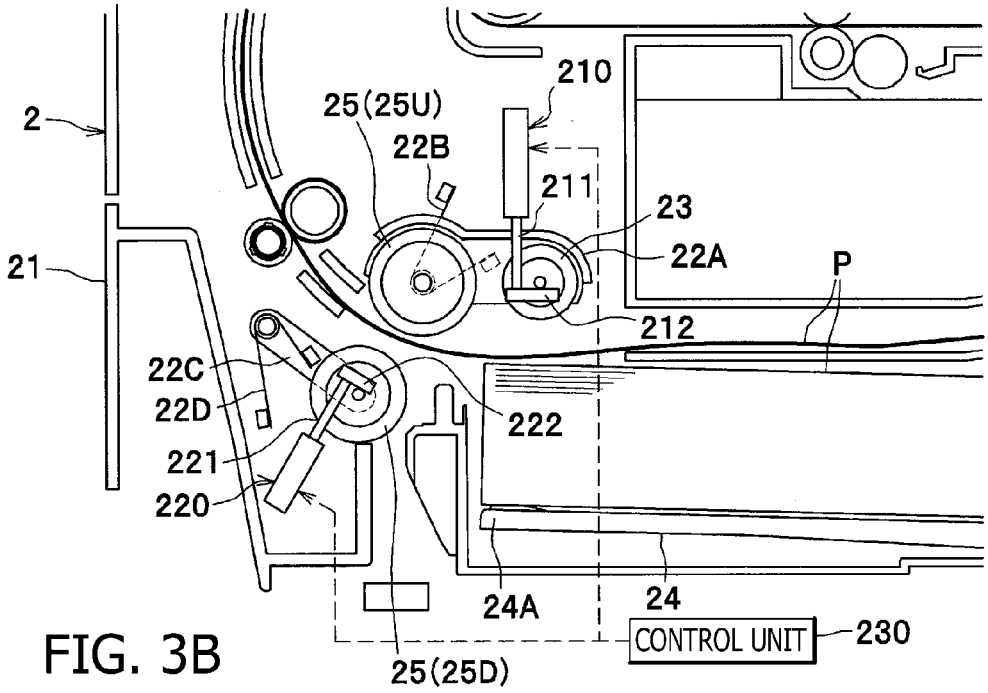
FIG. 3B illustrates the configuration around the paper supply tray and the separation rollers during back-face printing.

When the back face printing is performed, the first and second actuators 210 and 220 are driven so that, as shown in FIG. 3B, the paper supply roller 23 is moved away from the sheet of paper P, and the lower separation roller 25D is moved away from the upper separation roller 25U. As a result, a paper carrying path for the sheet of paper P being moved inversely is formed between the paper supply roller 23 and the sheet of paper P and between the pair of separation rollers 25.

As a result, the top face of the sheet of paper P, on which an image has been formed, being carried toward the paper supply roller 23 by the re-carrying mechanism 100 is prevented from contacting the paper supply roller 23 and the upper separation roller 25U. Consequently, it becomes possible to prevent the toner from adhering to the paper supply roller 23 and the upper separation roller 25.

According to the embodiment as described above, the following advantages can be achieved. Since the paper supply roller 23 moves away from the sheet of paper P supported by the pressure plate 24 during the back face printing, it is possible to prevent the paper supply roller 23 and the sheet of paper P from interfering with each other during the back face printing. In addition, since the pair of separation rollers 25 move away from each other during the back face printing, it is possible to prevent an image (toner) formed on the top face of the sheet of paper P from adhering to the upper separation roller 25U. If the toner adheres to the paper supply roller 23 or the upper separation roller 25U and then the toner adheres from the upper separation roller 25U to the lower separation roller 25D, the frictional force of each roller decreases when the sheet of paper P is supplied from the paper supply tray 21 by the paper supply roller 23 and the upper separation roller 25U for the top-face printing. By contrast, according to the above described configuration of the embodiment, duplicate carrying of the sheets of paper P can be prevented.

The timing for moving the separation rollers 25 away with respect to each other and moving the paper supply roller 23 away from the sheet of paper P may be set to a time point immediately before the leading edge of the sheet of paper P being carried inversely reaches corresponding one of the rollers 23 and 25, or may be set to a time point when the leading edge of the sheet of paper P is pinched by the carrying rollers 26. By suppressing the contact (friction) between the sheet of paper P and the separation rollers 25 as much as possible, it becomes possible to minimize the amount of paper dust caused by the friction between the sheet of paper P and the separation rollers 25. The timing for moving the paper supply roller 23 away from the sheet of paper P may be set to a time point when the leading edge of the sheet of paper P is pinched by the separation rollers 25. By suppressing the contact (friction) between the sheet of paper P and the paper supply roller 23 as much as possible, it becomes possible to minimize the amount of paper dust caused by the friction between the sheet of paper P and the paper supply roller 23.

Although the present invention has been described in considerable detail with reference to certain preferred embodiments thereof, other embodiments are possible.

Second Embodiment

Figure 4A:
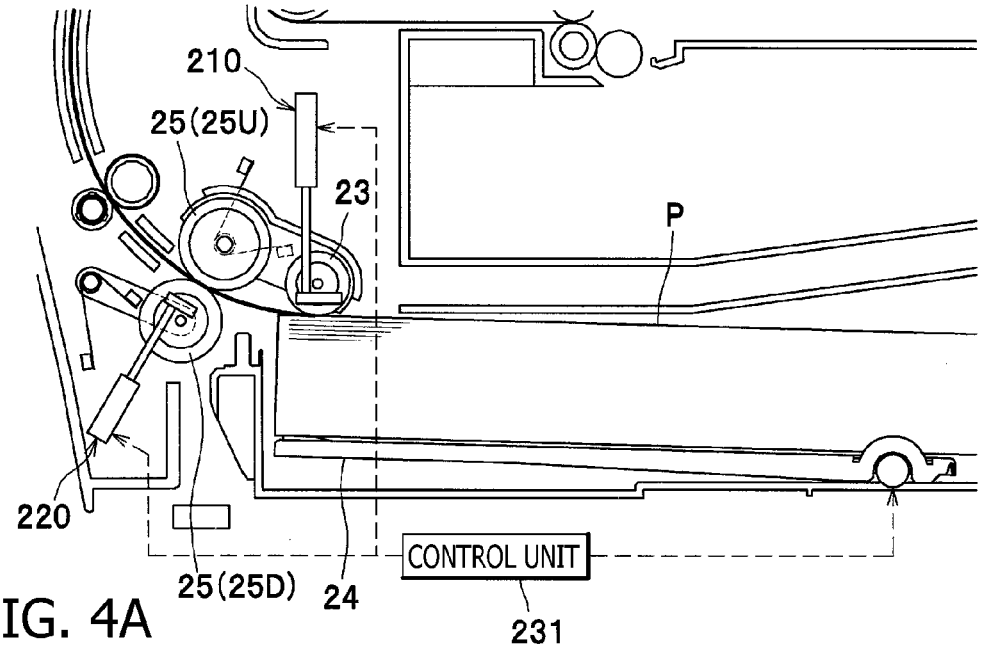
FIG. 4A illustrates a state of a pressure plate during the top-face orienting.
Figure 4B:
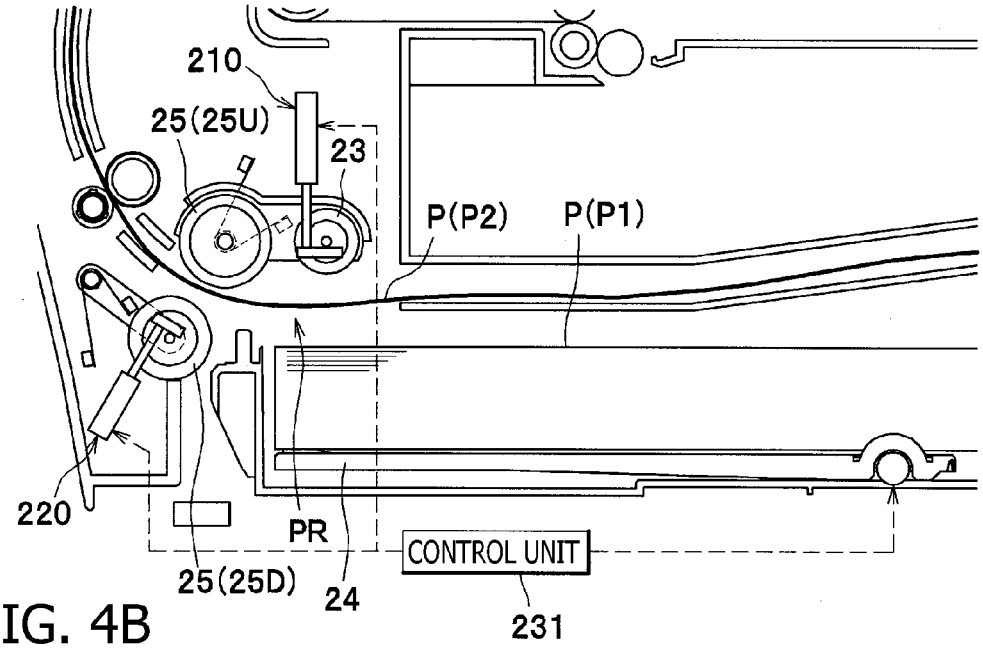
FIG. 4B illustrates a state of the pressure plate during the back-face printing where the pressure plate is lowered.

FIGS. 4A and 4B show a configuration of the color printer 1 according to a second embodiment. In the following, to elements, which are substantially the same as those of the first embodiment, the same reference numbers are assigned, and explanations thereof will not be repeated. In the following, the explanation focuses on the feature of the second embodiment. In the second embodiment, the up and down motion of the pressure plate 24 is driven by a driving source (e.g., a motor), and a control unit 231 controls the driving source. As in the case of the first embodiment, during the top-face printing, the paper supply roller 23 contacts the sheet of paper P in the paper supply tray 21, and the pair of separation rollers 25 contact with each other (see FIG. 4A). In this state, the pressure plate 24 is lifted up in accordance with decrease of the amount of the sheets of paper P in the paper supply tray 21. For the back-face printing, the pair of separation rollers 25 are moved away from each other, and the paper supply roller 23 is lifted and the pressure plate 24 is moved downward under control of the control unit 231. It should be noted that, for the back-face printing, only the pressure plate 24 may be moved downward and the paper supply roller 23 may be kept at a predetermined position.

With this configuration, by moving downward the pressure plate 24, it becomes possible to back the sheet of paper P (the sheet of paper P1 placed on the top of the stacked sheets of paper) supported by the pressure plate 24 from a path PR along which the sheet of paper P2 being re-carried. As a result, it becomes possible to prevent occurrence of the duplicate paper carrying of the sheets of paper which would occur when the sheet of paper P2 being re-carried contacts the sheet of paper P1 supported on the pressure plate 24.

Third Embodiment

Figure 5:
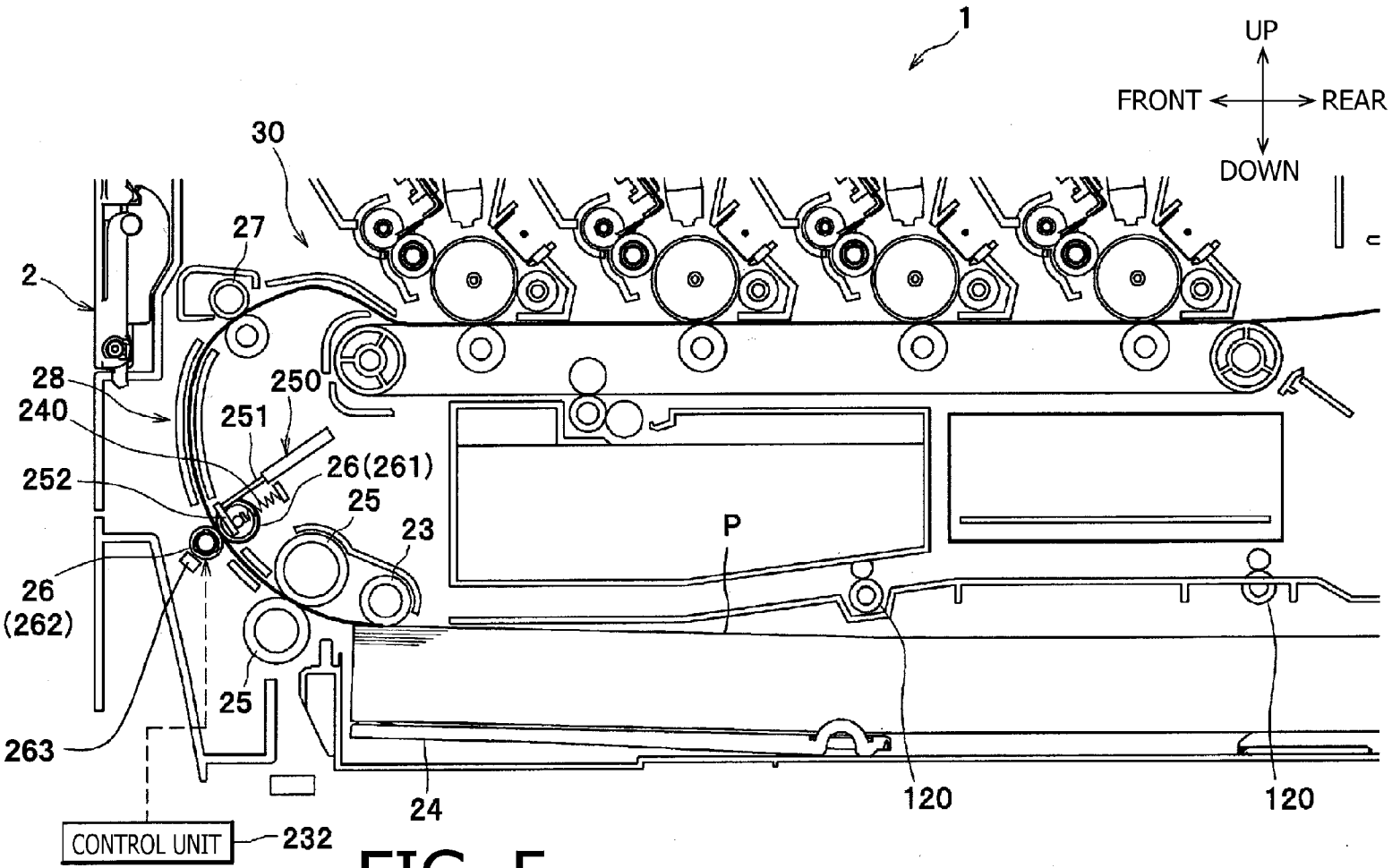
FIG. 5 illustrates a situation where a moving mechanism is provided for paper dust removing rollers.
Figure 6:
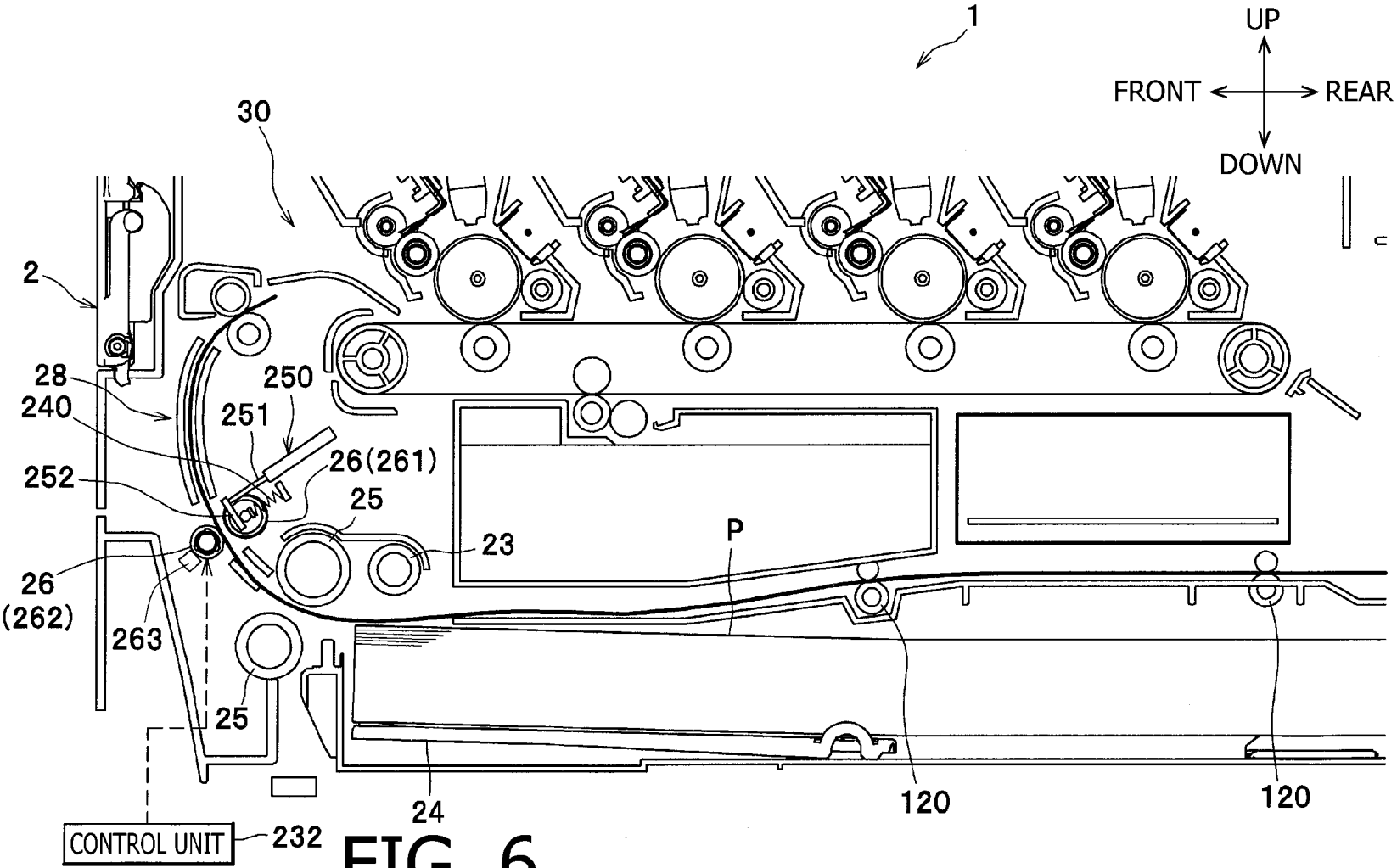
FIG. 6 illustrates a situation where the paper dust removing rollers are separated from each other.

FIGS. 5 and 6 show a configuration of the color printer 1 according to a third embodiment. In the following, to elements, which are substantially the same as those of the first embodiment, the same reference numbers are assigned, and explanations thereof will not be repeated. In the following, the explanation focuses on the feature of the third embodiment.

As in the case of the first embodiment, in the third embodiment, moving mechanisms are provided respectively for the paper supply roller 23 and the separation rollers 25.

In the third embodiment, a paper dust removing mechanism 263 is provided for the carrying rollers 26 located adjacent to the separation rollers 25 on the downstream side. The paper dust removing mechanism 263 is configured to remove the paper dust and foreign particles adhered to the outer surface of the roller 26 by causing a brush or a sponge (not shown) to contact the carrying roller 26. A third moving mechanism is provided for the paper dust removing mechanism 263.

The third moving mechanism includes a spring 240 which presses an inner roller 261 of the pair of rollers 26 toward an outer roller 262 for which the paper dust removing mechanism 263 is provided. The third moving mechanism further includes an actuator 250 having an advancing shaft 251 capable of moving the inner roller 261 to be closer to or away from the outer roller 262. At a tip of the advancing shaft 251, a hook part 252 capable of being hooked to the rotation shaft of the inner roller 261 in the advancing and backing direction of the advancing shaft 251 is provided.

As shown in FIG. 5, during the top-face printing, the control unit 232 causes the pair of carrying rollers 26 to contact with each other. During the back-face printing, the control unit 232 causes the paper supply roller 23 to be away from the sheet of paper P and causes the pair of separation rollers 25 to be away from each other (see FIG. 6). The actuator 250 is configured to hook the hook part 252 to the rotation shaft of the inner roller 261 by backing the advancing shaft 251, and thereby to draw inward the inner roller 261 against the pressing force from the spring 240 so that the pair of carrying rollers 26 are moved away from each other.

In view of the structure of the carrying rollers 26, since the printed face of the sheet of paper which has been subjected to the top face printing contacts the roller 261 made of rubber during the back-face printing, the toner on the printed face tends to be removed by the inner roller 261 made of rubber. However, according to the embodiment, it is possible to maintain the quality of image by causing the carrying rollers to move away from each other. It should be noted that, according to the embodiment, no paper dust is caused during the back-face printing in the configuration where the paper supply roller 23 is moved away from the sheet of paper and the pair of separation rollers 25 are moved way from each other during the back-face printing. As a result, according to the embodiment, the carrying rollers 26 can be moved away from each other.

Since, in the configuration shown in FIG. 5, the three types of rollers 23, 25 and 26 are backed from the paper carrying path 28 during the back-face printing, the sheet of paper P cannot be carried by the rollers 23, 25 and 26. Therefore, in the configuration, the most downstream side re-carrying roller 120 is located closer to the paper supply roller 23 in comparison with the case of the above described embodiment.

That is, an interval between the most downstream side re-carrying roller 120 and the pair of carrying rollers 27 provided on the downstream side of the carrying rollers 26 is set to be smaller than or equal to the length of the sheet of paper P having the minimum permissible size available for the back-face printing executed on the color printer 1.

Fourth Embodiment

Figure 7A:
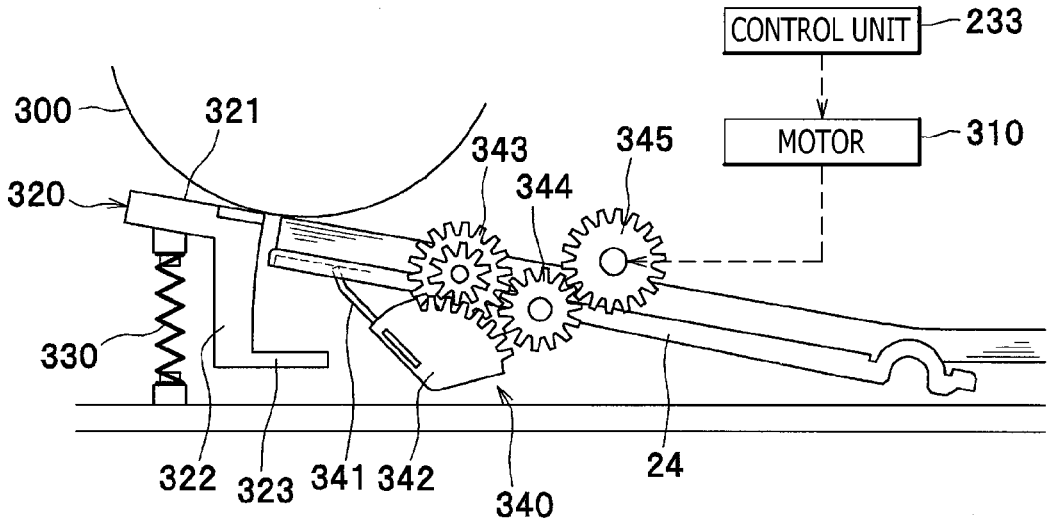
FIG. 7A illustrates a situation where the paper supply roller and the separation roller are integrally formed as a single paper supply and separation roller and the paper supply and separation roller is in the top-face printing.
Figure 7B:
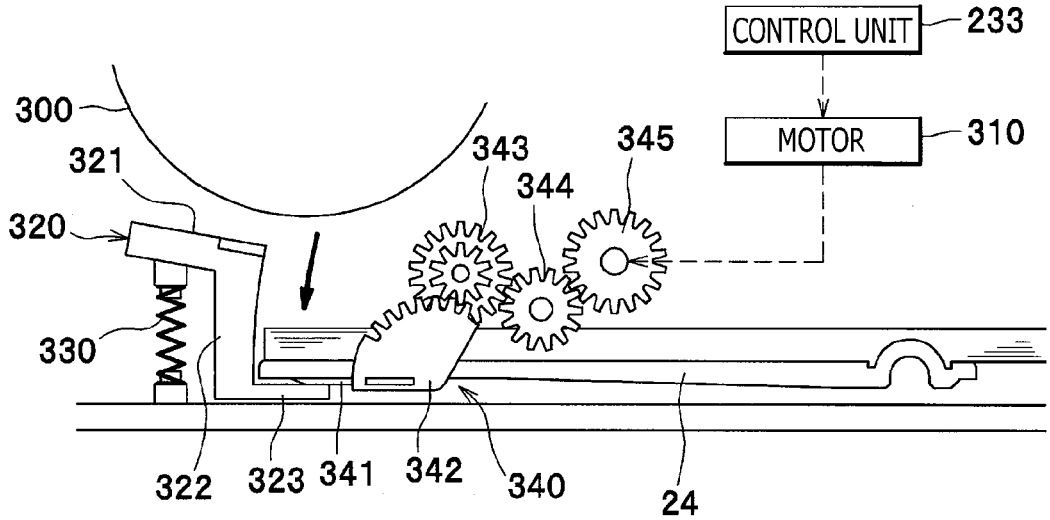
FIG. 7B illustrates a state where the paper supply and separation roller is in the back-face printing.

FIGS. 7A and 7B show a configuration of the color printer 1 according to a fourth embodiment. In the following, to elements, which are substantially the same as those of the first embodiment, the same reference numbers are assigned, and explanations thereof will not be repeated. In the following, the explanation focuses on the feature of the fourth embodiment.

As shown in FIGS. 7A and 7B, a single paper supply and separation roller 300 is provided to serve as both of the paper supply roller 23 and the upper separation roller 25U.

Specifically, in this case, the paper supply and separation roller 300 is provided to be rotatable and not to be movable in the vertical direction with respect to the main body. For the pressure plate 24 and a separation pad 320 (i.e., a friction member), a moving mechanism 340 is provided.

The moving mechanism 340 may have a known mechanism for moving the pressure plate 24 by the motor 310, and is configured to drive the pressure plate 23 and the separation pad 320 together to move away from the paper supply and separation roller 300 in conjunction with the downward movement of the pressure palate 24. Specifically, the moving mechanism 340 includes a pressing plate 341 located under the pressure plate 24, and a deltaic gear 342 which is supported to be able to swing in the main body and supports the pressing plate 341, the motor 310, and a plurality of gears 343, 344 and 345 which transmit the driving force of the motor 310 to the gear 342.

The separation pad 320 is provided to be movable in the vertical direction with respect to the main body. The separation pad 320 includes a pad part 321 contacting the paper supply and separation roller 300, a extending part 322 extending downward from the pad part 321, and a pressed part 323 extending from the lower edge of the extending part 322 to the lower side of the pressing plate 341. As shown in FIG. 7A, during the top-face printing, the control unit 233 drives the motor 310 to swing the pressing plate 341 toward the pressure plate 24 so that the pressure plate 24 is lifted and that the sheets of paper P on the pressure plate 24 contact the paper supply and separation roller 300. The separation pad 320 is moved upward by the pressing force from a spring 330 so that the pad part 321 contacts the paper supply and separation roller 300. As shown in FIG. 7B, during the back-face printing, the control unit 233 drives the motor 310 to swing the pressing plate 341 downward from the pressure plate 24. As a result, the pressure plate 24 moves downward by its own weight. At this time, the pressing plate 341 presses a pressed part 323 of the separation pad 320 to move downward the separation pad 320. As a result, the paper supply and separation roller 300 moves away from the pad part 321 and the sheets of paper P on the pressure plate 24, and thereby a path for sending the re-carried sheet of paper P to the image formation unit 30 is formed.

With this configuration, a known mechanism can be utilized for moving the pressure plate 24 in the vertical direction. Therefore, cost reduction can be realized. It should be noted that the separation pad 320 may be arranged to be pushed downward by the pressure plate 24.

Fifth Embodiment

Figure 8:
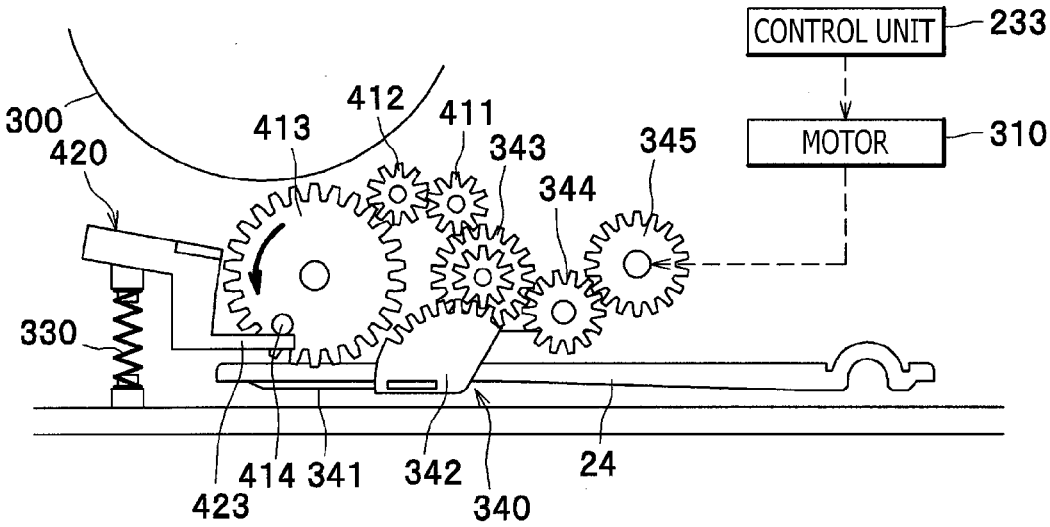
FIG. 8 illustrates a variation of the configuration shown in FIGS. 6A and 6B.

FIG. 8 shows a configuration of the color printer 1 according to a fifth embodiment. In the following, to elements, which are substantially the same as those of the fourth embodiment, the same reference numbers are assigned, and explanations thereof will not be repeated. In the following, the explanation focuses on the feature of the fifth embodiment.

In this embodiment, a plurality of gears 411, 412 and 413 may be joint to the gear 343 of the moving mechanism 340, and a pressed part of a separation pad 420 may be pressed by a projection 414 provided on a surface of a gear 413 located close to the separation pad 420. As a result, the paper supply and separation roller 300 is moved away from the pad part 321 during the back-face printing.

Sixth Embodiment

Figure 9A:
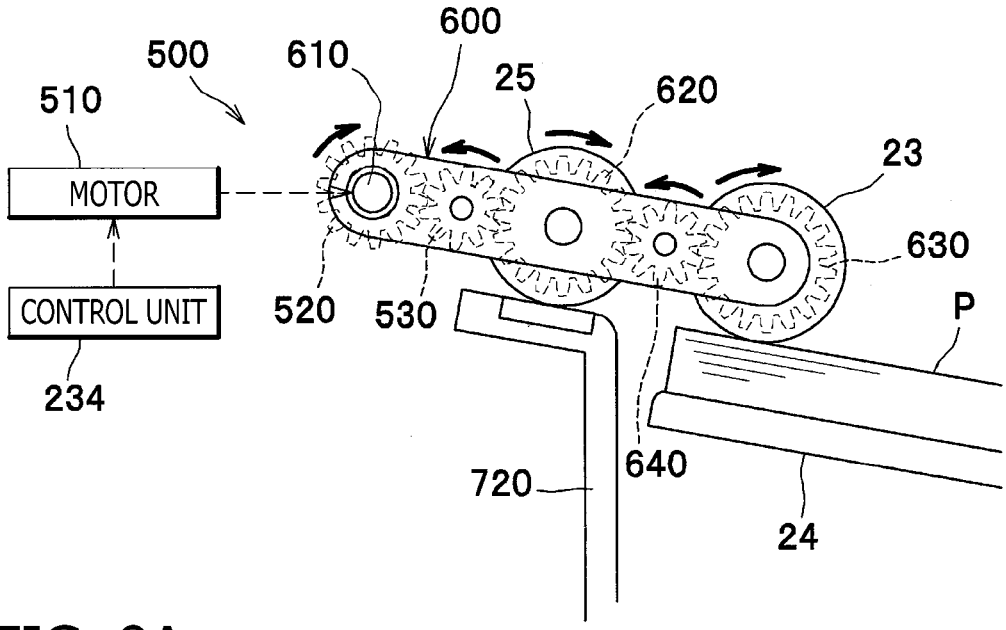
FIG. 9A illustrates a configuration where the paper supply roller and the separation roller are moved together in the vertical direction and the printer is in the state of top-face printing.
Figure 9B:
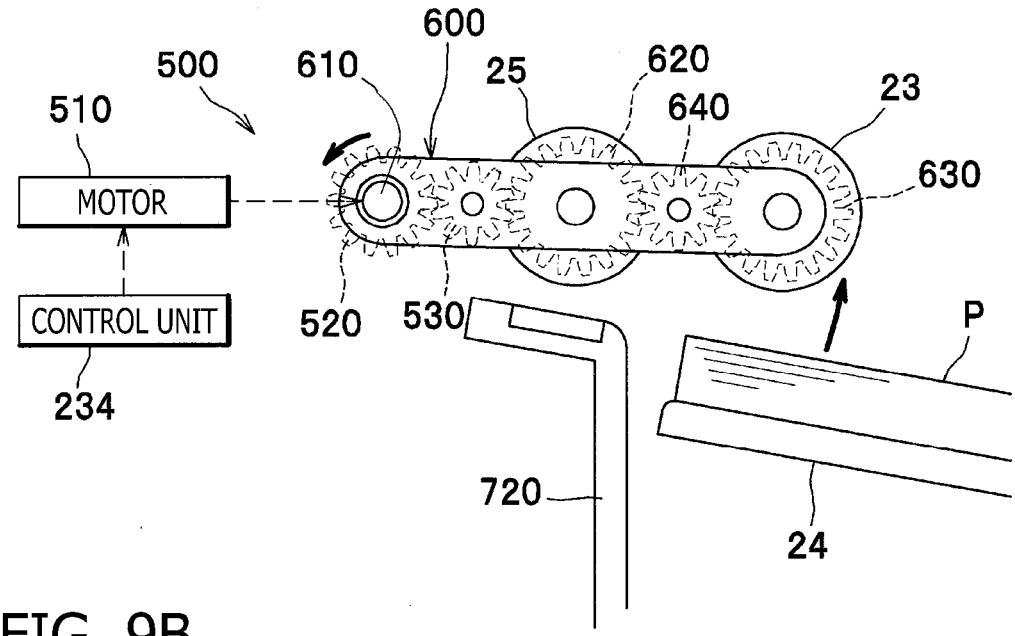
FIG. 9B illustrates the configuration where the paper supply roller and the separation roller are moved together in the vertical direction and the printer is in the state of back-face printing.

FIGS. 9A and 9B show a configuration of the color printer 1 according to a sixth embodiment. In the following, to elements, which are substantially the same as those of the fourth embodiment, the same reference numbers are assigned, and explanations thereof will not be repeated. In the following, the explanation focuses on the feature of the fifth embodiment.

As shown in FIGS. 9A and 9B, the paper supply roller 23 and the separation roller 25 are driven together by a single moving mechanism 500. A separation pad 720 (i.e., a friction member) is fixed with respect to the main body, and, as in the case of the above described other embodiments, the pressure plate 24 is moved upward or downward by a driving source such as a motor or a spring.

Specifically, each of the paper supply roller 23 and the separation roller 25 is rotatably supported by a bracket 600 which is provided to be able to swing with respect to an shaft 610. A series of gears for moving the paper supply roller 23 and the separation roller 25 driven by a motor 510 serve as a moving mechanism 500.

The series of gears include a gear 520, a separation roller drive gear 620, a supply roller drive gear 630, an intermediate gear 530, and an intermediate gear 640. The gear 520 is provided at the shaft 610 constituting the swinging center of a swinging arm 600, and a driving force from the motor 510 is transmitted to the gear 520. The separation roller drive gear 620 is able to rotate together with the separation roller 25. The supply roller drive gear 630 is able to rotate together with the paper supply roller 23. The intermediate gear 530 connects the gear 520 with the gear 620. The intermediate gear 640 connects the gear 620 with the gear 630.

As shown in FIG. 9A, during the top-face printing, a control unit 234 controls the motor 510 to rotate the gear 520 in the clockwise direction and thereby to rotate the bracket 600 in conjunction with rotation of the gear 520. As a result, the separation roller 25 contacts a separation pad 720, and the paper supply roller 23 contacts the sheet of paper P on the pressure plate 24. Then, the paper supply roller 23 and the separation roller 25 rotate via the series of gears, and thereby the sheets of paper P on the pressure plate 24 are supplied and separated one by one. It should be noted that, the bracket 600 may be pressed to contact the sheet of paper P by a pressing member, such as a spring.

When the sheet of paper P reaches the position where the sheet of paper P can be carried by the carrying rollers 26 and 27, the driving force to the paper supply roller 23 and the separation roller 25 is cut off. However, the paper supply roller 23 and the separation roller 25 are rotated together by the movement of the sheet of paper P being carried by the carrying rollers 26 and 27. A one-way clutch is provided between the separation roller 25 and the separation roller gear 620 so that, when the trailing edge of the sheet of paper P has departed from the paper supply roller 23 and the separation roller 25 is rotated in conjunction with the movement of the sheet of paper P, the rotation of the separation roller 25 is not transmitted to the paper supply roller 23.

During the back-face printing, as shown in FIG. 9B, since the control unit 234 controls the gear 520 to rotate in the counterclockwise direction, the swinging arm 600 also swings upward according to rotation of the gear 520, and the paper supply roller 23 and the separation roller 25 move away from the sheet of paper P on the pressure plate 24 and the separation pad 720. As a result, a path for carrying the re-carried sheet of paper P to the image formation unit 30 is formed between the paper supply roller 23 and the sheets of paper P and between the separation roller 25 and the separation pad 720. Such a configuration also makes it possible to achieve the cost reduction because only one moving mechanism 500 is required.

Hereafter, other embodiments are explained. In the above describe embodiments, the paper supply tray 21 which is detachably attachable to the main body 2 is employed. However, the present invention is not limited to such a configuration. For example, a sheet-like medium accommodation unit which is integrally formed with the main body may be employed.

In the above described embodiment, a sheet of paper P is used as an example of a sheet-like medium. However, the sheet-like medium includes a thick paper, a post card, and a thin paper. Furthermore, a resin sheet such as an OHP sheet may be used as a sheet-like medium.

As the spring used in the above described embodiments, various types of pressing members, such as a torsion spring, a leaf spring or a coil spring, may be employed. A motor or a solenoid may be used as a pressing member for pressing a roller or a separation pad to move close to each other.

In the above described embodiments where the lower separation roller is used, a separation pad may be employed in place of the lower separation roller. In the above described embodiments where the separation pad is used, a separation roller may be employed in place of the separation pad.

In the above described embodiment, the pair of separation rollers or the pair of separation roller and the separation pad are detached completely to have space therebetween. However, the present invention is not limited to such a configuration. For example, a nipping force (a pressing force) acting between the separation rollers may be controlled to be weakened in place of completely detaching the pair of separation rollers with respect to each other. Even in the case where the nipping force of the pair of separation rollers is merely weakened, it is possible to weaken the adhering force of the toner, and thereby it becomes possible to prevent occurrence of duplicate paper carrying.

In the above described embodiment, the disclosed feature is applied to the color printer 1. However, the present invention is not limited to such a configuration. For example, the disclosed feature may be applied to various types of image forming devices (a color or monochrome type) such as a copying device and a multifunction device.

In the above described embodiments, the expressions "the pressure plate is moved downward when the back-face printing is performed", "the pressure plate is moved downward during the back-face printing" and the similar expressions should be interpreted to mean that the pressure plate is lowered to execute the back-face printing, but it is not necessary to keep the pressure plate at the lowered position throughout the entire period of the back-face printing. That is, when the trailing edge of the sheet of paper has passed over the position of the pressure plate after the pressure plate is lowed, the pressure plate may be moved upward again.

What is claimed is:

1. An image forming device, comprising:

a sheet-like medium accommodation unit provided in a lower part of a main body;

a supply member that carries a sheet-like medium accommodated in the sheet-like medium accommodation unit;

a pair of separation members that separate the sheet-like medium carried by the supply member one by one and carry the sheet-like medium, the pair of separation members including a first separation member and a second separation member;

an image formation unit that is arranged above the sheet-like medium accommodation unit and is configured to form an image on the sheet-like medium carried from the pair of separation members;

a carrying path that is formed in a shape of a letter U to connect the sheet-like medium accommodation unit with the image formation unit, the supply member and the pair of separation members being arranged along the carrying path;

a re-carrying unit configured to move inversely the sheet-like medium whose top face has been subjected to printing by the image formation unit and to carry again the inversely moved sheet-like medium to the image formation unit through a portion between the supply member and the sheet-like medium accommodated in the sheet-like medium accommodation unit and a portion between the pair of separation members;

a moving mechanism configured to move the supply member close to or away from the sheet-like medium accommodated in the sheet-like medium accommodation unit and to move the pair of separation members close to or away from each other so that a path for the inversely carried sheet-like medium is formed between the supply member and the sheet-like medium accommodated in the sheet-like medium accommodation unit and between the pair of separation members; and a control unit configured to control the moving mechanism such that, when the sheet-like medium fed from the sheet-like medium accommodation unit passes between the pair of separation members, the first separation member is urged against the second separation member so as to pinch the sheet-like medium between the pair of separation members, and when the sheet-like medium is fed by the re-carrying unit, the supply member is in a state of being moved away from the sheet-like medium accommodated in the sheet-like medium accommodation unit and the pair of separation members are in a state of being moved away from each other so that the sheet-like medium passes between the pair of separation members.

2. The image forming device according to claim 1, wherein:

one of the pair of separation members is pressed by a pressing member; and the moving mechanism is configured to move the one of the separation members pressed by the pressing member against the pressing force from the pressing member.

3. The image forming device according to claim 1, wherein:

the sheet-like medium accommodation unit includes a pressure plate which is movable to lift up the sheet-like medium accommodated in the sheet-like medium accommodation unit; and the moving mechanism is configured to move downward the pressure plate when the back-face printing is performed.

4. The image forming device according to claim 3, wherein the moving mechanism is configured to move downward the pressure plate and to lift up the supply member.

5. The image forming device according to claim 1, wherein:

the image formation unit is configured to form an image of a developer on the sheet-like medium;

the re-carrying unit includes a pair of re-carrying rollers which carry the sheet-like medium while sandwiching therebetween the sheet-like medium whose top face has been subjected to the printing;

one of the pair of re-carrying rollers contacting the top face of the sheet-like recording medium is made of material having a property that a developer is hard to adhere thereto relative to material of the other of the pair of re-carrying rollers contacting the back-face of the sheet-like medium.

6. The image forming device according to claim 1, further comprising a pair of carrying rollers arranged along the carrying path between the pair of separation members and the image formation unit;

wherein:

the re-carrying unit includes a pair of re-carrying rollers which carry the sheet-like medium while sandwiching therebetween the sheet-like medium whose top face has been subjected to the printing; and the pair of carrying rollers and the pair of re-carrying rollers are arranged to have an interval which is smaller than or equal to a length of the sheet-like medium having a minimum permissible size which is allowed to be subjected to the back-face printing in the image forming device.

7. The image forming device according to claim 1, further comprising:

a plurality of pairs of carrying rollers provided along the carrying path between the pair of separation members and the image formation unit; and a paper dust removing mechanism provided for one of the plurality of pairs of carrying rollers, the paper dust removing mechanism serving to remove paper dust adhered to the sheet-like medium, wherein:

the moving mechanism is configured to drive the pair of carrying rollers for which the paper dust removing mechanism is provided to move closer to or away from each other; and the control unit is configured to control the moving mechanism such that, when the back-face printing is performed, the pair of carrying rollers for which the paper dust removing mechanism is provided are moved away from each other.

8. The image forming device according to claim 1, wherein:

the supply member is a supply roller;

one of the pair of separation members is a separation roller and the other of the pair of separation members is a friction member moved close to or away from the separation roller by the moving mechanism;

the supply roller is supported by a bracket which is provided to be able to swing and is swung by the moving mechanism in a direction of moving close to or away from the sheet-like medium accommodated in the sheet-like medium accommodation unit.

9. The image forming device according to claim 8, wherein:

the separation roller is supported by the bracket; and the separation roller is driven by the moving mechanism to move close to or away from the friction member.

10. The image forming device according to claim 1, further comprising a single paper supply and separation roller functioning as both of the supply member and one of the pair of separation members, wherein:

the other of the pair of separation members is a friction member;

the single paper supply and separation roller is arranged such that, by the moving mechanism, a part of an outer surface of the single paper supply and separation roller and the sheet-like medium accommodated in the sheet-like medium accommodation unit are moved close to or away from each other, and a part of the outer surface of the single paper supply and separation roller and the friction member are moved close to or away from each other on a downstream side of the sheet-like medium in the sheet-like medium accommodation unit.

11. The image forming device according to claim 1, wherein:

the sheet-like medium accommodation unit includes a pressure plate arranged to be movable to lift up the sheet-like medium accommodated in the sheet-like medium accommodation unit; and the moving mechanism is configured to drive one of the pair of separation members to move away from the other of the pair of separation members in conjunction with movement of the pressure plate to become away from the supply member.

12. The image forming device according to claim 11, wherein:

the sheet-like medium accommodation unit includes a driving mechanism having a motor to drive the pressure plate to move close to or away from the supply member;

the one of the pair of separation members is pressed by a pressing force of a pressing member toward the other of the pair of separation members;

the moving mechanism lets the one of the pair of separation members to move close to the other of the pair of separation members through the pressing force of the pressing member when the pressure plate is situated to be close to the supply member;

the moving mechanism drives the one of the pair of separation members to move away from the other of the pair of separation members against the pressing force of the pressing member in accordance with movement of the pressure plate to move away from the supply member.

* * * * *